US005657590A

United States Patent [19]

Digman et al.

[11] Patent Number: 5,657,590

[45] Date of Patent: Aug. 19, 1997

[54] MUNTIN BAR ASSEMBLY

[75] Inventors: Rodney J. Digman, Wausau, Wis.; Clemith E. Sorey, Chatsworth; Robert E. Daniels, Jr., Fairbury, both of Ill.

[73] Assignee: Quanex Corporation, Houston, Tex.

[21] Appl. No.: 590,776

[22] Filed: Jan. 24, 1996

[51] Int. Cl.[6] ..... E04C 2/42; E04C 2/38; E04B 1/58

[52] U.S. Cl. ..... 52/204.61; 52/311.3; 52/656.8; 52/730.3; 52/730.4; 52/730.5; 52/734.2

[58] Field of Search ..... 52/204.61, 204.62, 52/204.53, 734.2, 656.8, 730.1, 730.6, 730.5, 731.2, 731.4, 732.1, 730.3, 730.4, 456, 311.3

[56] References Cited

U.S. PATENT DOCUMENTS

| | | | |
|---|---|---|---|
| 1,997,876 | 4/1935 | Sheldon | 52/731.2 |
| 2,604,196 | 7/1952 | Peremi et al. . | |
| 2,675,896 | 4/1954 | Van Pelt | 52/730.6 X |
| 2,975,874 | 3/1961 | Pagan | 52/731.2 X |
| 3,234,704 | 2/1966 | Burgess et al. | 52/731.2 |
| 3,282,005 | 11/1966 | Birdwell | 52/731.2 X |
| 3,307,316 | 3/1967 | Gray . | |
| 3,611,666 | 10/1971 | Poyser et al. | 52/732.1 |
| 3,645,058 | 2/1972 | Jacobson et al. . | |
| 4,718,213 | 1/1988 | Butterfield | 52/732.1 |
| 4,723,388 | 2/1988 | Zieg . | |
| 4,970,846 | 11/1990 | Ouellette et al. | 52/204.61 |
| 4,987,717 | 1/1991 | Dameron | 52/732.1 |
| 5,031,083 | 7/1991 | Claesson | 52/732.1 X |
| 5,099,626 | 3/1992 | Seeger | 52/734.2 X |
| 5,131,199 | 7/1992 | Clark . | |
| 5,165,208 | 11/1992 | Lingemann | 52/734.2 X |
| 5,274,976 | 1/1994 | Burkhart . | |
| 5,291,710 | 3/1994 | Golen . | |
| 5,351,459 | 10/1994 | Kassel et al. . | |
| 5,464,302 | 11/1995 | Menchetti | 52/731.2 X |
| 5,473,853 | 12/1995 | Guillemet et al. | 52/656.9 X |

*Primary Examiner*—Robert Canfield
*Attorney, Agent, or Firm*—Lee, Mann, Smith, McWilliams, Sweeney & Ohlson

[57] ABSTRACT

A muntin bar strip member adapted to interconnect to a cooperating strip member. The strip member has a wall member; a coupling means, such as a flange, extending from a longitudinal edge of the wall member; and a female coupling member, such as a channel, extending along an opposite longitudinal edge of the wall member. A muntin bar can be formed from a strip member interconnected to a second similarly structured strip member, where the flange of the second strip member is engaged in the channel of the first strip member, and conversely the flange of the first strip member engaged in the channel of the second strip member.

12 Claims, 3 Drawing Sheets

MUNTIN BAR ASSEMBLY

BACKGROUND OF THE INVENTION

The present invention pertains to a strip member that is a component of a muntin bar assembly and to a two-piece muntin bar assembly made therefrom.

Muntin bars are often used for decorative purposes to divide light in windows and make a large integral window appear as if it were formed of a number of smaller window panes separated from each other. Decorative muntin bars simulate the colonial style of numerous panes of glass in individual wooden frames. Prior art muntin bars are integrally formed. Such prior art muntin bars may be coated in a variety of matching colors to coordinate with the color of the sash of the window; however, these muntin bars are not suited to easily have two distinct colors or textures respectively located on the interior and exterior surfaces of the muntin bar.

Muntin bars in many colors, textures, and surface configurations are required to be stocked by builder's supply houses to satisfy modem interior decorating tastes. In addition to the many colors, textures, and surface configurations desired, many manufacturers and customers are now demanding muntin bars with different colors, textures, and surface configurations on the interior and exterior surfaces of an individual muntin bar. For example, a front door may have a natural wood finish on the outside surface with a white finish on the inside surface. The homeowner may require a muntin bar assembly which duplicates the door and has a wood grain exterior surface and a white interior surface. Such arrangements were not available in integrally formed prior art designs.

Painting and roll forming a muntin bar in two different colors, textures, or surface configurations would create major difficulties in manufacturing. A large inventory of different types of muntin bars would have to be maintained in order to satisfy customer requirements for muntin bars having the numerous different color, texture, and surface configuration combinations. For example, if the interior and exterior surface of a muntin bar are each formed with one of four different surface configurations, ten different styles of muntin bars would have to be maintained in inventory to cover all of the possible combinations that may be requested of the four surface configurations. As the number of selections of colors, textures, and configurations increases, the required stock of muntin bars in each combination quickly becomes unmanageable.

For the foregoing reasons, there is a need for a versatile muntin bar assembly that can be easily assembled from separate interior and exterior strips.

SUMMARY OF THE INVENTION

The present invention is directed to a decorative muntin bar assembly formed from an interior first strip member and an exterior second strip member, wherein each strip member may be formed in various colors, textures, and surface configurations. The muntin bar assembly is adapted for use with different types of windows. Each strip member may be adapted to interconnect to a similarly constructed cooperating strip member. Each strip member includes an elongate wall member having first and second longitudinally extending edges. A male coupling member, such as a flange, is attached to the first longitudinal edge of the wall member. A female coupling member, such as a channel, is attached to the second longitudinal edge of the wall member. If desired, the two strip members may be mirror images of each other.

The muntin bar assembly is formed by interconnecting the first strip member with the second similarly constructed strip member. The flange of the second strip member is inserted and retained in the channel of the first strip member, and conversely the flange of the first strip member is inserted and retained in the channel of the second strip member.

This construction allows each strip member of the muntin bar to be prepainted and roll formed with the desired color, texture, and surface configuration. Each strip member of the muntin bar assembly can be made in a variety of colon, textures, and surface configurations. The different types of prepainted and prefinished strip members can be mixed and matched in assembling a muntin bar to provide a large number of combinations of colors, textures, and surface configurations for the interior and exterior sides of the muntin bar assembly from a relatively few different types of strip members.

The muntin bar assembly may be located on only one side of a pane of glass in a window or between panes of glass in an insulated window. The muntin bar assembly is preferably attached to the window frame with end connectors.

DETAILED DESCRIPTION OF THE PREFERRED EMBODIMENTS

Figure 1:
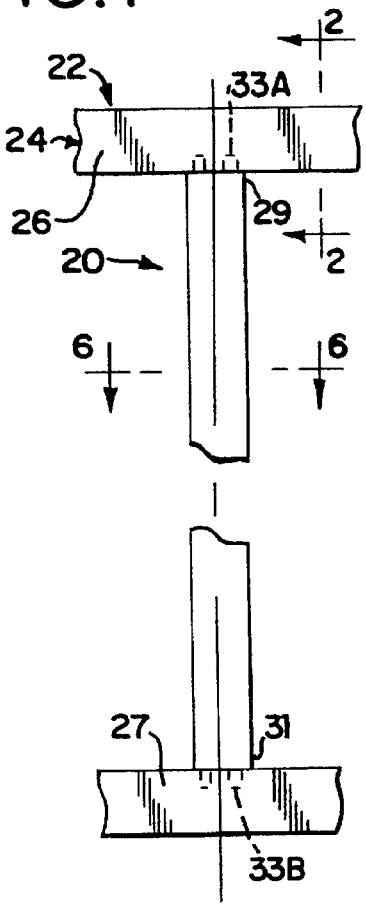
FIG. 1 is a front elevational view of the muntin bar of the present invention shown attached to the frame of a window.
Figure 2:
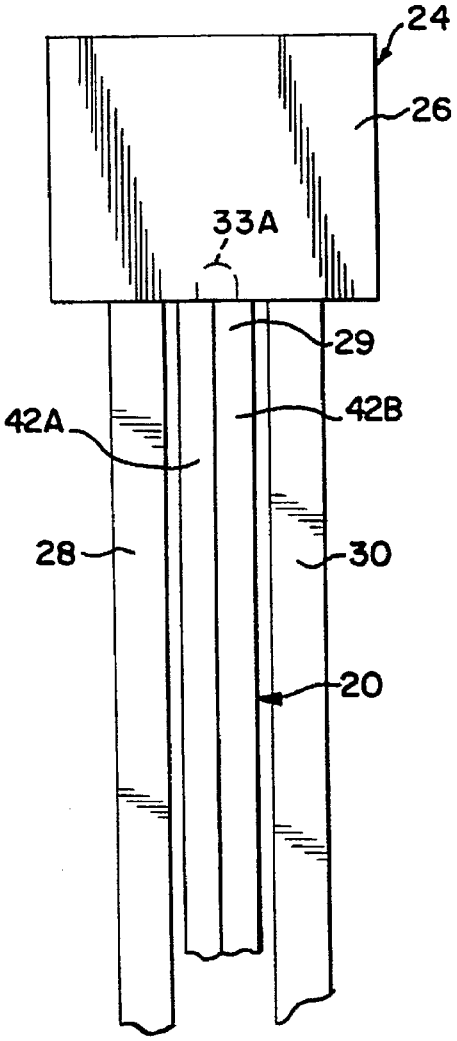
FIG. 2 is an enlarged partial side elevational view of the muntin bar shown between two panes of glass taken along lines 2—2 of FIG. 1.

The muntin bar assembly 20 of the present invention is shown in FIG. 1 attached to a window unit 22. The window unit 22 includes a window frame 24 having spaced apart and opposing frame members 26 and 27 and two spaced apart panes of glass 28 and 30. As best shown in FIG. 2, the muntin bar assembly 20 is located between the panes of glass 28 and 30, but may be located to the exterior of either pane 28 or 30 or on opposite sides of a single pane of glass. The muntin bar assembly 20 includes a first end 29 removably attached to the window frame member 26 with an end connector 33A and a second end 31 removably attached to the window frame member 27 with an end connector 33B.

Figure 3:
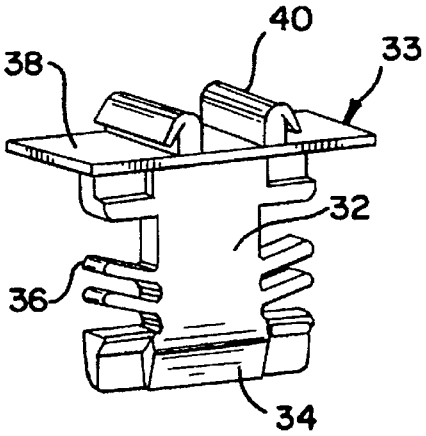
FIG. 3 is a perspective view of an end connector which may be used to attach the muntin bar assembly to a window frame.
Figure 4:
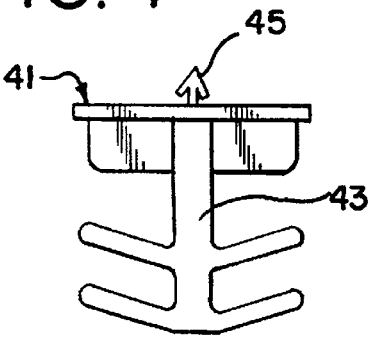
FIG. 4 is a front elevational view of an alternate end connector.

Each end connector 33 is preferably molded from nylon or another suitable plastic and can be used to mount a complete grill bar assembly formed from a plurality of muntin bars to a window unit 22. In the embodiment illustrated in FIG. 3, the end connector 33 consists of a spine 32 having a stabilizing end 34 and angled fins 36 projecting outwardly from the spine 32. The stabilizing end 34 is adapted to be inserted into the open ends 29 and 31 of the muntin bar assembly 20. The angled fins 36 press easily into the open ends 29 and 31 of the muntin bar assembly 20 and tend to expand and press against the sides of the muntin bar assembly 20 making the end connector 33 somewhat difficult to remove. The opposite end of the end connector 33 includes an end stop platform 38 for engaging the end 29 or 31 of the muntin bar assembly 20. The end stop platform 38 includes barbed pins 40 that fit into mating holes in the window frame members 26 and 27 to secure the muntin bar 20 in place. FIG. 4 shows an alternate embodiment of an end connector 41 having a narrow spine 43 and a single barbed pin 45.

Figure 5:
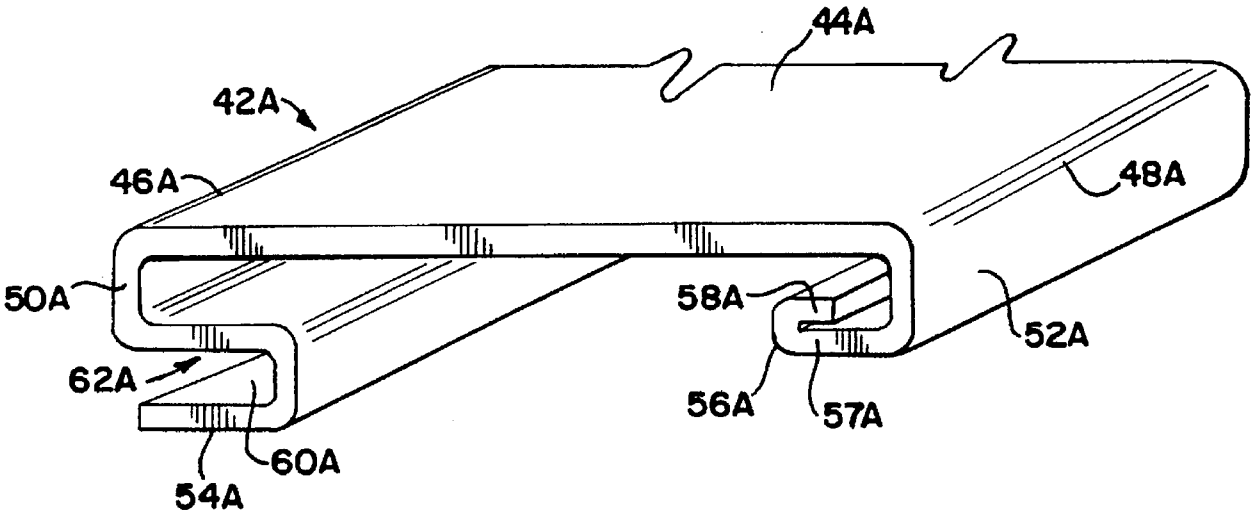
FIG. 5 is a perspective view of a strip member of the muntin bar assembly of the present invention.
Figure 6:
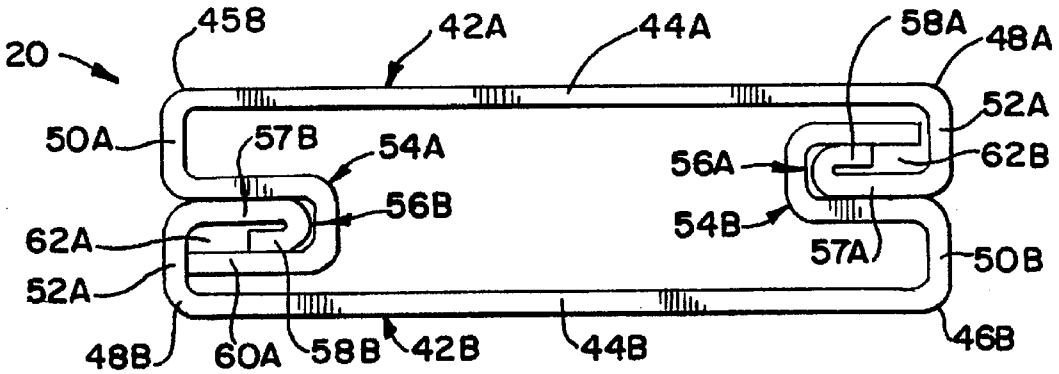
FIG. 6 is a cross sectional view of the muntin bar assembly taken along lines 6—6 of FIG. 1.

The muntin bar assembly 20 includes two cooperating strip members 42A and 42B, as shown in FIG. 6, which are constructed substantially identical to each other. One of the strip members 42A or B faces the interior of the window while the other strip member faces the exterior of the window. As shown in FIGS. 5 and 6, the strip member 42A has an elongate generally planar wall member 44A having an outer display surface, a first longitudinally extending edge 46A and a spaced apart and generally parallel second longitudinally extending edge 48A. A first side wall 50A is attached to the first edge 46A and a second side wall 52A is attached to the second edge 48A. The side walls 50A and 52A are generally perpendicular to the wall member 44A and extend from the wall member 44A in the same direction. A male coupling member 56A is connected to the side wall 52A. The male coupling member 56A comprises a flange 57A which extends inwardly from the side wall 52A generally parallel to the wall member 44A. A bent-over lip 58A is connected to the flange 57A and extends generally parallel and adjacent thereto. A female coupling member 54A is connected to the side wall 50A. The female coupling member 54A comprises a generally C-shaped channel 60A having a longitudinal groove 62A. The channel 60A extends inwardly from the side wall 50A such that the groove 62A is open in a direction facing away from the flange 57A and to the exterior of the strip member 42A. The female coupling member 54A is adapted to receive and retain a male coupling member on a cooperating strip member.

The strip member 42B, as shown in FIG. 6, is constructed similarly to the strip member 42A. The strip member 42B has an elongate generally planar wall member 44B having an inner display surface, a first longitudinally extending edge 46B and a spaced apart and generally parallel second longitudinally extending edge 48B. A first side wall 50B is attached to the first edge 46B and a second side wall 52B is attached to the second edge 48B. The side walls 50B and 52B are generally perpendicular to the wall member 44B. A male coupling member 56B is attached to the side wall 52B. The male coupling member 56B comprises a flange 57B which includes a bent-over lip 58B. The male coupling member 56B is adapted to be inserted into the groove 62A of the female coupling member 54A and to be retained by the female coupling member 54A of the strip member 42A. A female coupling member 54B is attached to the side wall 50B. The female coupling member 54B comprises a generally C-shaped channel 60B having a longitudinal groove 62B. The female coupling member 54B is adapted to receive and retain the male coupling member 56A of the strip member 42A.

As shown in FIG. 6, the muntin bar assembly 20 is formed when cooperating strip members 42A and 42B are interconnected. The male coupling member 56A of the strip member 42A is inserted into the groove 62B of the female coupling member 54B of the cooperating strip member 42B and is removably or permanently retained by the female coupling member 54B. The male coupling member 56B of the cooperating strip member 42B is inserted into the longitudinal groove 62A of the female coupling member 54A and is removably or permanently retained by the female coupling member 56B. The strip member 42A may be formed in a first color, or with a first surface texture, while the strip member 42B may be formed in a second color, or with a second surface texture. The muntin bar 20 thereby can provide two different appearances, one appearance being viewed from the exterior of the window and the other being viewed from the interior of the window.

Figure 7:
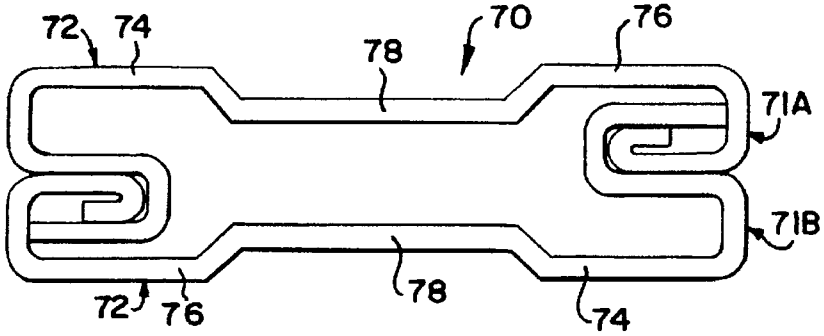
FIG. 7 is a cross sectional view of an alternate embodiment of a muntin bar assembly.

FIG. 7 shows an alternate embodiment 70 of a muntin bar assembly. The muntin bar assembly 70 is constructed substantially the same as the muntin bar assembly 20 shown in FIG. 6 except that the strip members 71A and 71B of the muntin bar assembly 70 each include a wall member 72 including two spaced apart coplanar portions 74 and 76 and a center portion 78 located between the coplanar portions 74 and 76. The center portion 78 is parallel to the coplanar portions 74 and 76, but is inwardly displaced forming a depression in the outer surface of the strip member 71.

Figure 8:
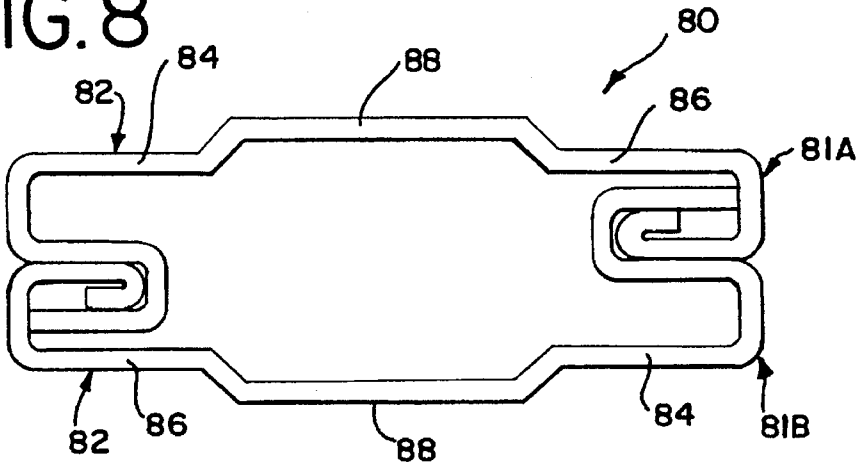
FIG. 8 is a cross sectional view of another alternate embodiment of a muntin bar assembly.

FIG. 8 shows another alternate embodiment 80 of a muntin bar assembly. The muntin bar assembly 80 is constructed substantially the same as the muntin bar assembly 20 shown in FIG. 6 except that the strip members 81A and 81B of the muntin bar assembly 80 each include a wall member 82 including two spaced apart coplanar portions 84 and 86 and a center portion 88 located between the coplanar portions 84 and 86. The center portion 88 is outwardly raised to form a ridge with a surface substantially parallel to the coplanar portions 84 and 86.

Figure 9:
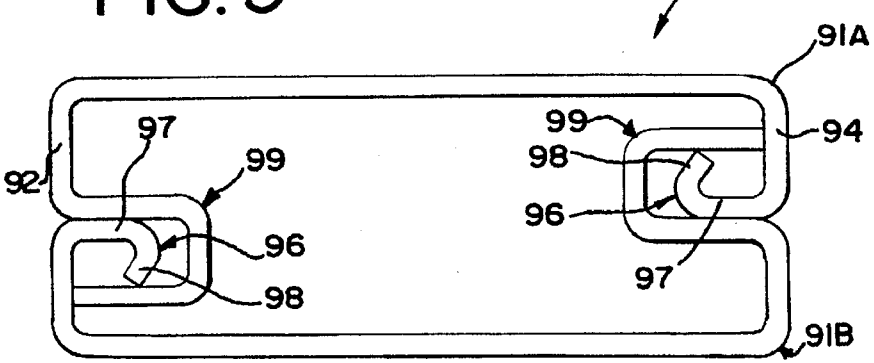
FIG. 9 is a cross sectional view of another alternate embodiment of a muntin bar assembly.

FIG. 9 shows another alternate embodiment 90 of a muntin bar assembly. The muntin bar assembly 90 is constructed substantially the same as the muntin bar assembly 20 shown in FIG. 6 except that the strip members 91A and 91B of the muntin bar assembly 90 include side walls 92 and 94 and a male coupling member 96 having a flange 97 with a bent lip 98. The bent lip 98 does not overlap the flange 97 of the male coupling member 96, but extends outwardly from the flange 97 to grip the female coupling member 99 at its tip.

Figure 10:
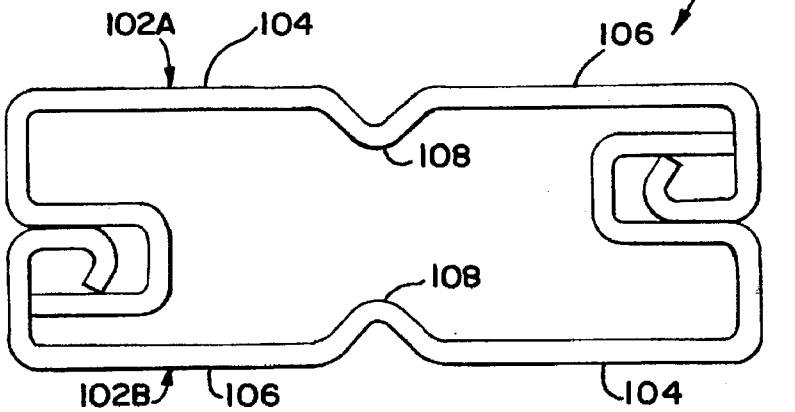
FIG. 10 is a cross sectional view of another alternate embodiment of a muntin bar assembly.

FIG. 10 shows an alternate embodiment 100 of a muntin bar assembly. The muntin bar assembly 100 is constructed substantially the same as muntin bar assembly 90 shown in FIG. 9 except that each wall member 102A and 102B includes two coplanar potions 104 and 106 and a center portion 108 located between the coplanar potions 104 and 106. The center portion 108 comprises an inwardly formed ridge that is generally V-shaped.

The muntin bar assembly has been shown and described herein as including two strip members which are substantially identical to one another. However, it is contemplated that different types of strip members, formed with different colors, textures, or surface configurations, will be used with one another to form a muntin bar assembly that presents different interior and exterior appearances. For example, the strip member 42A, shown in FIG. 6, can be coupled to the strip member 71, shown in FIG. 7, to form a muntin bar assembly.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A window assembly including:

a pane of glass; and a muntin bar assembly located adjacent to said pane of glass, said muntin bar assembly including:

a first muntin bar strip member including a first elongate wall member having an outer display surface, a longitudinally extending first edge and a longitudinally extending second edge, a first means for coupling attached to said first edge of said first muntin bar strip member, and a second means for coupling attached to said second edge of said first muntin bar strip member; and a second muntin bar strip member adapted to be secured to said first muntin bar strip member including a second elongate wall member having an inner display surface, a longitudinally extending first edge and a longitudinally extending second edge, a third means for coupling attached to said first edge of said second muntin bar strip member, said third coupling means of said second muntin bar strip member being coupled to said second coupling means of said first muntin bar strip member, and a fourth means for coupling attached to said second edge of said second muntin bar strip member, said fourth coupling means of said second muntin bar strip member being coupled to said first coupling means of said first muntin bar strip member.

2. The window assembly of claim 1 wherein said first coupling means of said first muntin bar strip member and said third coupling means of said second muntin bar strip member respectively comprise first and second male coupling members.

3. The window assembly of claim 2 wherein said second coupling means of said first muntin bar strip member and said fourth coupling means of said second muntin bar strip member respectively comprise first and second female coupling members, said first female coupling member of said first muntin bar strip member adapted to receive said second male coupling member of said second muntin bar strip member and said second female coupling member of said second muntin bar strip member adapted to receive said first male coupling member of said first muntin bar strip member.

4. The window assembly of claim 1 wherein said first coupling means of said first muntin bar strip member and said third coupling means of said second muntin bar strip member respectively comprise a first flange and a second flange.

5. The window assembly of claim 4 wherein said second coupling means of said first muntin bar strip member and said fourth coupling means of said second muntin bar strip member respectively comprise a first channel-shaped member and a second channel-shaped member, said first channel-shaped member adapted to receive said second flange and said second channel-shaped member adapted to receive said first flange.

6. The window assembly of claim 4 wherein said first flange includes a bent lip member.

7. The window assembly of claim 1 wherein said first muntin bar strip member is constructed substantially identically to said second muntin bar strip member.

8. The window assembly of claim 1 including a first end and a second end, and a connector means associated with said first end for securing said first end to the window.

9. The window assembly of claim 8 wherein said connector means includes a spine adapted to be located between said first and second muntin bar strip members.

10. The window assembly of claim 9 wherein said connector means includes a pin adapted for insertion into the window.

11. A method of forming a window assembly comprising the steps of:

providing a first muntin bar strip member including a first elongate wall member having a longitudinally extending first edge and a longitudinally extending second edge, a first means for coupling attached to said first edge of said first muntin bar strip member, and a second means for coupling attached to said second edge of said first muntin bar strip member;

providing a second muntin bar strip member including a second elongate wall member having a longitudinally extending first edge and a longitudinally extending second edge, a third means for coupling attached to said first edge of said second muntin bar strip member, said third coupling means of said second muntin bar strip member adapted to be coupled to said second coupling means of said first muntin bar strip member, and a fourth means for coupling attached to said second edge of said second muntin bar strip member, said fourth coupling means of said second muntin bar strip member adapted to be coupled to said first coupling means of said first muntin bar strip member;

coupling said first coupling means of said first muntin bar strip member to said fourth coupling means of said second muntin bar strip member;

coupling said second coupling means of said first muntin bar strip member to said third coupling means of said second muntin bar strip member such that said first and second strip members form a muntin bar assembly; and placing said muntin bar assembly adjacent to a pane of glass.

12. The method of claim 11 wherein said placing step further comprises placing said muntin bar assembly between a pair of spaced apart panes of glass.

* * * * *